US010730086B2

(12) United States Patent
Yamashita

(10) Patent No.: US 10,730,086 B2
(45) **Date of Patent: *Aug. 4, 2020**

(54) METHOD FOR PRODUCING H-SHAPED STEEL

(71) Applicant: NIPPON STEEL CORPORATION, Tokyo (JP)

(72) Inventor: Hiroshi Yamashita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 203 days.

This patent is subject to a terminal disclaimer.

(21) Appl. No.: 15/559,310

(22) PCT Filed: Mar. 10, 2016

(86) PCT No.: PCT/JP2016/057647

§ 371 (c)(1),
(2) Date: Sep. 18, 2017

(87) PCT Pub. No.: WO2016/148030

PCT Pub. Date: Sep. 22, 2016

(65) Prior Publication Data

US 2018/0111178 A1 Apr. 26, 2018

(30) Foreign Application Priority Data

Mar. 19, 2015 (JP) ..... 2015-056638

(51) Int. Cl.
*B21B 1/088* (2006.01)
*B21B 27/02* (2006.01)
(Continued)

(52) U.S. Cl.
CPC ..... *B21B 1/088* (2013.01); *B21B 27/02* (2013.01); *B21B 1/0883* (2013.01); *B21B 13/06* (2013.01);
(Continued)

(58) Field of Classification Search
CPC ..... B21B 1/088; B21B 27/02; B21B 2267/18; B21B 2267/02; B21B 2013/106; B21B 1/0883; B21B 13/06
See application file for complete search history.

(56) References Cited

U.S. PATENT DOCUMENTS 4,402,206 A * 9/1983 Yanazawa ..... D06M 15/673 72/221
4,420,961 A * 12/1983 Kusaba ..... B21B 1/088 72/221
(Continued)

FOREIGN PATENT DOCUMENTS

CN 1745917 A 3/2006
CN 201070634 Y 6/2008
(Continued)

OTHER PUBLICATIONS

Japanese Office Action, dated Oct. 30, 2018, for Japanese Application No. 2017-506506, along with a Partial English translation.
(Continued)

*Primary Examiner* — Ryan J. Walters
(74) *Attorney, Agent, or Firm* — Birch, Stewart, Kolasch & Birch, LLP

(57) ABSTRACT

[Object] To suppress occurrence of shape defects in a material to be rolled and enable efficient and stable production of an H-shaped steel product with a flange width larger than a conventional flange width by creating deep splits on end surfaces of a material (e.g., slab) using projections with acute-angle tip shapes, and sequentially bending formed flange portions.
[Solution] Provided is a method for producing H-shaped steel, the method including: a rough rolling step; an intermediate rolling step; and a finish rolling step. In a rolling mill that performs the rough rolling step, a plurality of calibers to shape a material to be rolled are engraved, the
(Continued)

number of the plurality of calibers being four or more. Shaping of one or a plurality of passes is performed on the material to be rolled in the plurality of calibers. In a first caliber and a second caliber among the plurality of calibers, projections to create splits vertically with respect to a width direction of the material to be rolled are formed. In a second caliber and subsequent calibers among the plurality of calibers, reduction is performed in a state where end surfaces of the material to be rolled are in contact with caliber peripheral surfaces in shaping of at least one pass. In a third caliber and subsequent calibers among the plurality of calibers, a step of sequentially bending divided parts formed by the splits is performed.

10 Claims, 14 Drawing Sheets

(51) Int. Cl.
*B21B 13/10* (2006.01)
*B21B 13/06* (2006.01)

(52) U.S. Cl.
CPC ..... *B21B 2013/106* (2013.01); *B21B 2267/02* (2013.01); *B21B 2267/18* (2013.01)

(56) References Cited

U.S. PATENT DOCUMENTS

| | | | | |
|---|---|---|---|---|
| 4,637,241 | A * | 1/1987 | Michaux | B21B 1/088 72/225 |
| 5,009,094 | A | 4/1991 | Hayashi et al. | |
| 2018/0071801 | A1* | 3/2018 | Yamashita | B21B 1/088 |
| 2018/0111178 | A1 | 4/2018 | Yamashita | |

FOREIGN PATENT DOCUMENTS

| | | | |
|---|---|---|---|
| CN | 202762723 | U | 3/2013 |
| CN | 103056160 | A | 4/2013 |
| JP | 52-20958 | A | 2/1977 |
| JP | 58-188501 | A | 11/1983 |
| JP | 60-21101 | A | 2/1985 |
| JP | 7-88501 | A | 4/1995 |
| JP | 7-164003 | A | 6/1995 |
| JP | 7-178404 | A | 7/1995 |
| JP | 11-347601 | A | 12/1999 |
| JP | 2000-246304 | A | 9/2000 |
| JP | 2002-45902 | A | 2/2002 |
| JP | 2004-358541 | A | 12/2004 |
| JP | 2013-43186 | A | 3/2013 |

OTHER PUBLICATIONS

Extended European Search Report dated Nov. 13, 2018, for corresponding European Application No. 16764860.9.
International Search Report for PCT/JP2016/057647 dated Apr. 12, 2016.
Written Opinion of the International Searching Authority for PCT/JP2016/057647 (PCT/ISA/237) dated Apr. 12, 2016.
Chinese Office Action and Search Report for corresponding Chinese Application No. 201680016996.2, dated Jul. 3, 2018, with partial English translation.
Chinese Office Action and Search Report dated Jul. 12, 2018, for Chinese Application No. 201680016843.8, with an English translation of the Office Action.
Extended European Search Report dated Nov. 9, 2018, for European Application No. 16764858.3.
International Search Report for PCT/JP2016/057631 (PCT/ISA/210) dated Apr. 12, 2016, with English translation.
Japanese Office Action dated Nov. 6, 2018, for Japanese Application No. 2017-506504, with an English translation.
Kenchikuyo Shizai Handbook, Nippon Steel & Sumitomo Metal Corporation, [online], Aug. 2014, [retrieval date Mar. 31, 2016], Internet:<URL:http://www.nssmc.com/product/catalog_download/pdf/E001.pdf>, pp. 152, 153.
U.S. Office Action dated Jul. 29, 2019, for U.S. Appl. No. 15/559,373.
Written Opinion of the International Searching Authority for PCT/JP2016/057631 (PCT/ISA/237) dated Apr. 12, 2016.
U.S. Office Action dated Jan. 17, 2020, for U.S. Appl. No. 15/559,373.
Notice of Allowance dated Mar. 27, 2020, for U.S. Appl. No. 15/559,373.

* cited by examiner

METHOD FOR PRODUCING H-SHAPED STEEL

CROSS REFERENCE TO RELATED APPLICATIONS

This application claims the benefit of Japanese Priority Patent Application JP 2015-056638 filed Mar. 19, 2015, the entire contents of each of which are incorporated herein by reference.

TECHNICAL FIELD

The present invention relates to a method for producing H-shaped steel using a slab or the like having a rectangular cross-section as a material, for example, and a produced H-shaped steel product.

BACKGROUND ART

In the case where H-shaped steel is produced, a material, such as a slab or a bloom, extracted from a heating furnace is shaped into a raw blank (a material to be rolled with a so-called dog-bone shape) by a rough rolling mill (BD). Thicknesses of a web and flanges of the raw blank are subjected to reduction by an intermediate universal rolling mill, and moreover, flanges of a material to be rolled are subjected to width reduction and forging and shaping of end surfaces by an edger rolling mill close to the intermediate universal rolling mill. Then, an H-shaped steel product is shaped by a finishing universal rolling mill.

In such a method for producing H-shaped steel, a technology is known (e.g., see Patent Literature 1) in which, in shaping a raw blank with a so-called dog-bone shape from a slab material having a rectangular cross-section, splits are created on slab end surfaces in a first caliber of a rough rolling step, the splits are then widened or made deeper and edging rolling is performed in a second caliber and subsequent calibers, and the splits on the slab end surfaces are erased in subsequent calibers.

In addition, for example, Patent Literature 2 discloses a technology of forming flange-corresponding portions of H-shaped steel by creating splits on slab end surfaces, sequentially making the splits deeper, and then expanding the splits in a box caliber.

CITATION LIST

Patent Literature

Patent Literature 1: JP H7-88501A
Patent Literature 2: JP S60-21101A

SUMMARY OF INVENTION

Technical Problem

In recent years, an increase in size of structures and the like has brought about demands for production of large-size H-shaped steel products. In particular, there have been demands for a product in which flanges, which greatly contribute to strength and rigidity of H-shaped steel, are made wider than conventional flanges. To produce an H-shaped steel product with widened flanges, it is necessary to shape a material to be rolled with a flange width larger than a conventional flange width from the stage of shaping in the rough rolling step.

However, there is a limit in widening of flanges in a method in which splits are created on end surfaces of a material such as a slab (slab end surfaces) and the end surfaces are subjected to edging, and the spread is utilized for rough rolling, in the technology disclosed in Patent Literature 1, for example. That is, in order to widen flanges, conventional rough rolling methods use technologies such as wedge designing (designing of a split angle), reduction adjustment, and lubrication adjustment to improve spread, but none of the methods greatly contributes to a flange width; thus, it is known that the rate of spread, which indicates the ratio of a flange spread amount with respect to an edging amount, is approximately 0.8 even under a condition in which efficiency at the initial stage of edging is the highest, decreases as the flange spread amount increases under a condition in which edging is repeated in the same caliber, and finally becomes approximately 0.5. It may also be possible to increase the size of the material (e.g., slab) itself to increase the edging amount, but product flanges are not sufficiently widened because there are device limits in equipment scale and an amount of reduction of rough rolling mills.

In the technology disclosed in Patent Literature 2, for example, flange-corresponding portions are shaped in a manner that a material (e.g., slab) provided with splits is immediately subjected to edging rolling by a box caliber with a flat bottom surface, without undergoing transition of split shapes or the like. Such a method tends to cause shape defects that accompany a rapid change in the shape of a material to be rolled. In particular, a change in the shape of a material to be rolled in such shaping is determined by the relation between the force of a contact portion of the material to be rolled and a roll and the flexural rigidity of the material to be rolled, and there is a problem in that shape defects are more likely to occur in the case where H-shaped steel with a flange width larger than a conventional flange width is produced.

In view of such circumstances, an object of the present invention is to provide a method for producing H-shaped steel, the method suppressing occurrence of shape defects in a material to be rolled and enabling efficient and stable production of an H-shaped steel product with a flange width larger than a conventional flange width by, in a rough rolling step using calibers in producing H-shaped steel, creating deep splits on end surfaces of a material (e.g., slab) using projections with acute-angle tip shapes, and sequentially bending flange portions formed by the splits.

Solution to Problem

According to the present invention in order to achieve the above-mentioned object, there is provided a method for producing H-shaped steel, the method including: a rough rolling step; an intermediate rolling step; and a finish rolling step. In a rolling mill that performs the rough rolling step, a plurality of calibers to shape a material to be rolled are engraved, the number of the plurality of calibers being four or more. Shaping of one or a plurality of passes is performed on the material to be rolled in the plurality of calibers. In a first caliber and a second caliber among the plurality of calibers, projections to create splits vertically with respect to a width direction of the material to be rolled are formed. In a second caliber and subsequent calibers among the plurality of calibers, reduction is performed in a state where end surfaces of the material to be rolled are in contact with caliber peripheral surfaces in shaping of at least one pass. In two or more of a third caliber and subsequent calibers among the plurality of calibers, a step of sequentially bending divided parts formed by the splits is performed. The projections formed in the first caliber and the second caliber have a tip angle of 40° or less.

The pass in which reduction is performed in a state where the end surfaces of the material to be rolled are in contact with the caliber peripheral surfaces may be a final pass in shaping of a plurality of passes using each of the second caliber and subsequent calibers among the plurality of calibers.

In the second caliber, inclined surfaces of the projections and caliber peripheral surfaces that are adjacent to the inclined surfaces and face the end surfaces of the material to be rolled may form substantially perpendicular angles.

The projections formed in the first caliber and the second caliber may have a tip angle of equal to or more than 25° and equal to or less than 35°.

Projections that are pressed against the divided parts to bend the divided parts may be formed in the third caliber and subsequent calibers among the plurality of calibers. Inclined surfaces of the projections and caliber peripheral surfaces that are adjacent to the inclined surfaces and face the end surfaces of the material to be rolled may form substantially perpendicular angles.

The projections formed in the second caliber and subsequent calibers among the plurality of calibers may have tip angles sequentially increasing toward subsequent calibers.

The plurality of calibers may be four calibers of first to fourth calibers to shape the material to be rolled. In the third caliber and the fourth caliber among the plurality of calibers, a step of sequentially bending divided parts formed by the splits may be performed. Projections formed in the third caliber may have a tip angle of equal to or more than 70° and equal to or less than 110°. Projections formed in the fourth caliber may have a tip angle of equal to or more than 130° and equal to or less than 170°.

Advantageous Effects of Invention

According to the present invention, it is possible to suppress occurrence of shape defects in a material to be rolled and efficiently and stably produce an H-shaped steel product with a flange width larger than a conventional flange width by, in a rough rolling step using calibers in producing H-shaped steel, creating deep splits on end surfaces of a material (e.g., slab) using projections with acute-angle tip shapes, and sequentially bending flange portions formed by the splits.

REFERENCE SIGNS LIST

Figure 1:
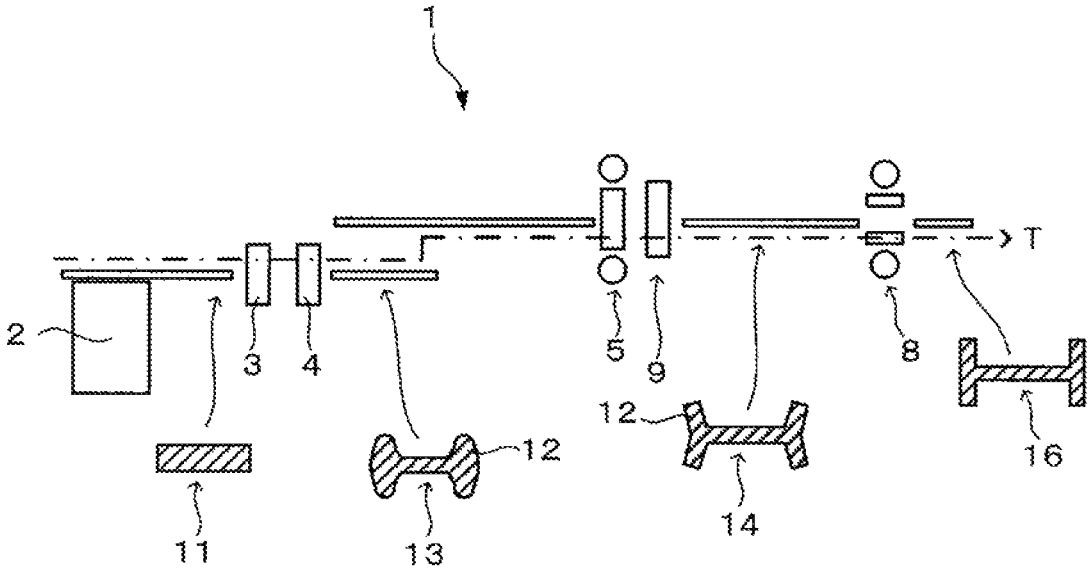
FIG. 1 is a schematic explanatory diagram for a production line of H-shaped steel.

1 rolling equipment
2 heating furnace
3 sizing mill
4 rough rolling mill
5 intermediate universal rolling mill
8 finishing universal rolling mill
9 edger rolling mill
11 slab
12 flange-corresponding portion
13 H-shaped raw blank
14 intermediate material
16 H-shaped steel product
20 upper caliber roll (first caliber)
21 lower caliber roll (first caliber)
25, 26 projection (first caliber)
28, 29 split (first caliber)
30 upper caliber roll (second caliber)
31 lower caliber roll (second caliber)
35, 36 projection (second caliber)
38, 39 split (second caliber)
40 upper caliber roll (third caliber)
41 lower caliber roll (third caliber)
45, 46 projection (third caliber)
48, 49 split (third caliber)
50 upper caliber roll (fourth caliber)
51 lower caliber roll (fourth caliber)
55, 56 projection (fourth caliber)
58, 59 split (fourth caliber)
80 flange portion
K1 first caliber
K2 second caliber
K3 third caliber
K4 fourth caliber
T production line
A material to be rolled

DESCRIPTION OF EMBODIMENTS

Hereinafter, (an) embodiment(s) of the present invention will be described with reference to the drawings. In this specification and the appended drawings, structural elements that have substantially the same function and structure are denoted with the same reference numerals, and repeated explanation of these structural elements is omitted.

FIG. 1 is an explanatory diagram for a production line T of H-shaped steel including rolling equipment 1 according to the present embodiment. As illustrated in FIG. 1, a heating furnace 2, a sizing mill 3, a rough rolling mill 4, an intermediate universal rolling mill 5, and a finishing universal rolling mill 8 are arranged in order from the upstream side in the production line T. In addition, an edger rolling mill 9 is provided close to the intermediate universal rolling mill 5. In the description below, steel materials in the production line T are collectively referred to as a "material to be rolled A" for description, and the shape thereof is illustrated with broken lines and oblique lines as appropriate in each drawing in some cases.

As illustrated in FIG. 1, in the production line T, the material to be rolled A, such as a slab 11, extracted from the heating furnace 2 is roughly rolled in the sizing mill 3 and the rough rolling mill 4, and then is subjected to intermediate rolling in the intermediate universal rolling mill 5. In this intermediate rolling, reduction is performed on end portions (flange-corresponding portions 12) of the material to be rolled, for example, by the edger rolling mill 9 as necessary. In a normal case, approximately four to six calibers in total are engraved on rolls of the sizing mill 3 and the rough rolling mill 4, and an H-shaped raw blank 13 is shaped through reverse rolling of approximately a little over ten passes by way of these calibers. Reduction of a plurality of passes is applied to the H-shaped raw blank 13 using a rolling mill train composed of two rolling mills of the intermediate universal rolling mill 5 and the edger rolling mill 9; thus, an intermediate material 14 is shaped. The intermediate material 14 is finish-rolled into a product shape in the finishing universal rolling mill 8, so that an H-shaped steel product 16 is produced.

Next, description will be given on configurations and shapes of calibers that are engraved in the sizing mill 3 and the rough rolling mill 4 illustrated in FIG. 1, with reference to drawings. Normally, the rough rolling mill 4 is further provided with, in addition to first to fourth calibers described below, a caliber for making the material to be rolled A that has been shaped in these calibers into the H-shaped raw blank 13 with a so-called dog-bone shape; this caliber is a conventionally known caliber and therefore illustration and description thereof are omitted in this specification. The heating furnace 2, the intermediate universal rolling mill 5, the finishing universal rolling mill 8, the edger rolling mill 9, and the like in the production line T are general devices conventionally used in production of H-shaped steel, and their device configurations and the like are known; thus, description of these devices is omitted in this specification.

FIGS. 2 to 5 are schematic explanatory diagrams for calibers that are engraved in the sizing mill 3 and the rough rolling mill 4, which perform a rough rolling step. Here, first to fourth calibers to be described may all be engraved in the sizing mill 3, for example, or four calibers of the first to fourth calibers may be engraved separately in the sizing mill 3 and the rough rolling mill 4. That is, the first to fourth calibers may be engraved across both the sizing mill 3 and the rough rolling mill 4, or may be engraved in either one of the rolling mills. In a rough rolling step in normal production of H-shaped steel, shaping in one or a plurality of passes is performed in each caliber.

In the present embodiment, a case where four calibers are engraved is described as an example, but the number of calibers is not necessarily four, and there may be a plurality of calibers, the number of the plurality of calibers being four or more. That is, any caliber configuration suitable for shaping the H-shaped raw blank 13 may be employed. Note that FIGS. 2 to 5 illustrate, with broken lines, the schematic final-pass shape of the material to be rolled A in shaping in each caliber.

Figure 2:
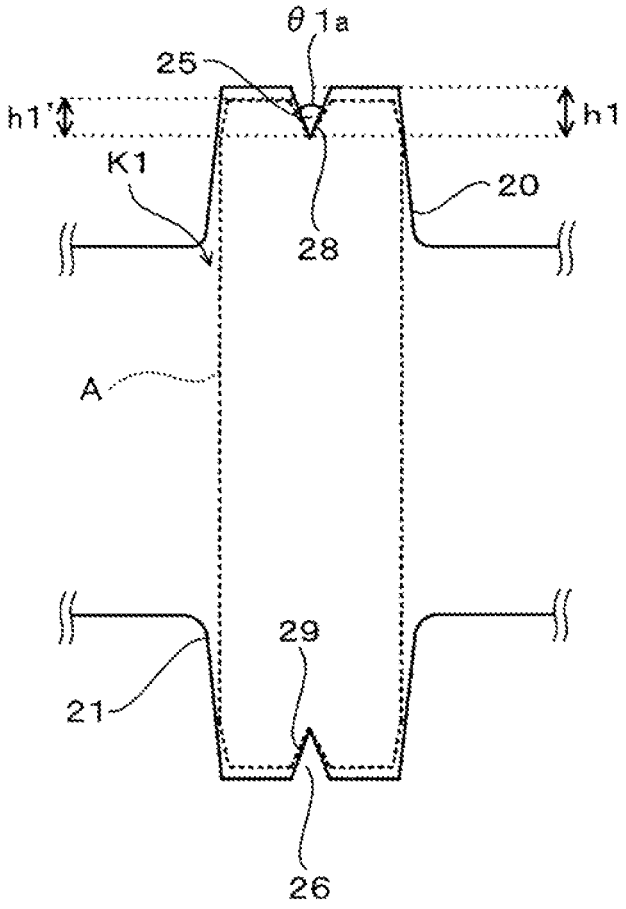
FIG. 2 is a schematic explanatory diagram of a first caliber.

FIG. 2 is a schematic explanatory diagram of a first caliber K1. The first caliber K1 is engraved on a pair of horizontal rolls, an upper caliber roll 20 and a lower caliber roll 21, and the material to be rolled A is subjected to reduction and shaping in a roll gap between the upper caliber roll 20 and the lower caliber roll 21. On a peripheral surface of the upper caliber roll 20 (i.e., a top surface of the first caliber K1), a projection 25 protruding toward the inside of the caliber is formed. Furthermore, on a peripheral surface of the lower caliber roll 21 (i.e., a bottom surface of the first caliber K1), a projection 26 protruding toward the inside of the caliber is formed. These projections 25 and 26 have tapered shapes, and dimensions, such as protrusion length, are configured to be equal between the projections 25 and 26. The height (protrusion length) of the projections 25 and 26 is denoted by h1, and a tip-portion angle thereof is denoted by θ1*a*.

In this first caliber K1, the projections 25 and 26 are pressed against upper and lower end portions of the material to be rolled A (slab end surfaces) to form splits 28 and 29. Here, the tip-portion angle of the projections 25 and 26 (also called a wedge angle) θ1*a* is preferably equal to or more than 25° and equal to or less than 40°, for example, further preferably equal to or more than 25° and equal to or less than 35°. The reason for this will be described later with reference to FIGS. 6 to 8.

Here, a caliber width of the first caliber K1 is preferably substantially equal to a thickness of the material to be rolled A (i.e., a slab thickness). Specifically, when the width of the caliber at the tip portions of the projections 25 and 26 formed in the first caliber K1 is set to be the same as the slab thickness, the property of left-right centering of the material to be rolled A is ensured suitably. Moreover, it is preferable to employ this configuration of caliber dimensions so that, in shaping using the first caliber K1, the projections 25 and 26 and part of side surfaces (side walls) of the caliber be in contact with the material to be rolled A at the upper and lower end portions of the material to be rolled A (the slab end surfaces), and active reduction not be performed by the top surface and the bottom surface of the first caliber K1 on slab upper and lower end portions, which are divided into four elements (parts) by the splits 28 and 29, as illustrated in FIG. 2. This is because reduction by the top surface and the bottom surface of the caliber causes stretch of the material to be rolled A in the longitudinal direction, which decreases efficiency in generating flanges (flange portions 80 described later). That is, in the first caliber K1, an amount of reduction at the projections 25 and 26 (amount of reduction ΔT at wedge tips) when the projections 25 and 26 are pressed against upper and lower end portions of the material to be rolled A (slab end surfaces) to form the splits 28 and 29 is set to be sufficiently larger than an amount of reduction at the slab upper and lower end portions (amount of reduction ΔE at slab end surfaces); thus, the splits 28 and 29 are formed.

Figure 3:
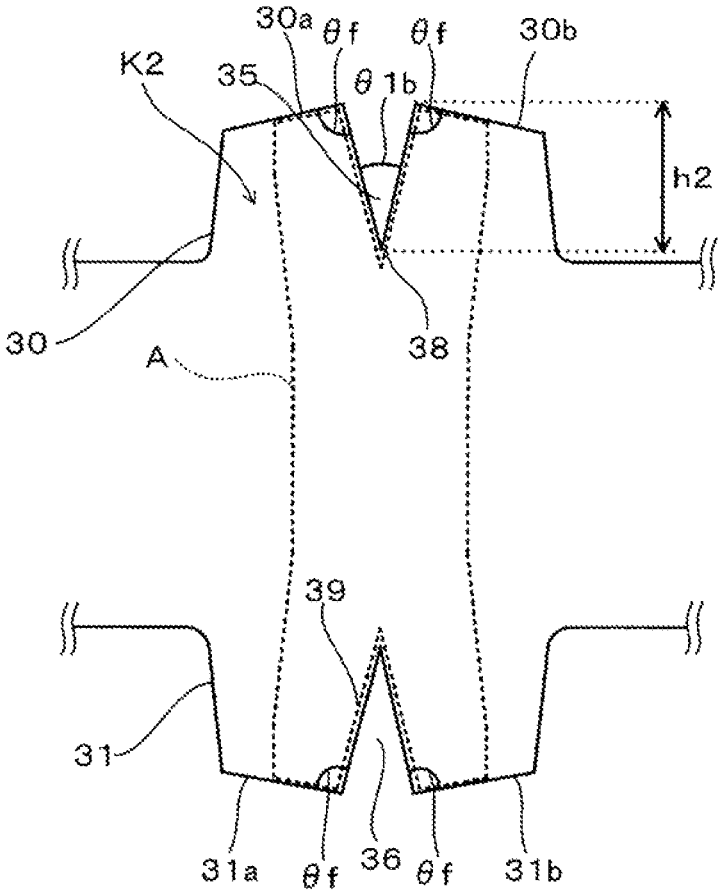
FIG. 3 is a schematic explanatory diagram of a second caliber.

FIG. 3 is a schematic explanatory diagram of a second caliber K2. The second caliber K2 is engraved on a pair of horizontal rolls, an upper caliber roll 30 and a lower caliber roll 31. On a peripheral surface of the upper caliber roll 30 (i.e., a top surface of the second caliber K2), a projection 35 protruding toward the inside of the caliber is formed. Furthermore, on a peripheral surface of the lower caliber roll 31 (i.e., a bottom surface of the second caliber K2), a projection 36 protruding toward the inside of the caliber is formed. These projections 35 and 36 have tapered shapes, and dimensions, such as protrusion length, are configured to be equal between the projections 35 and 36. The tip-portion angle of the projections 35 and 36 is preferably a wedge angle θ1*b* of equal to or more than 25° and equal to or less than 40°, further preferably equal to or more than 25° and equal to or less than 35°.

Here, description is given on reasons for setting the suitable numerical range of the wedge angle θ1*b* of the projections 35 and 36 to equal to or more than 25° and equal to or less than 40° (further preferably equal to or more than 25° and equal to or less than 35°) and a reason for accordingly setting the wedge angle θ1*a* of the first caliber K1 to the suitable numerical range.

A lower limit value of a wedge angle is normally decided by the strength of a roll. The material to be rolled A comes into contact with the rolls (the upper caliber roll 30 and the lower caliber roll 31 in the second caliber K2, and the upper caliber roll 20 and the lower caliber roll 21 in the first caliber K1), and the rolls are subjected to heat during the contact to swell, and when the material to be rolled A goes out of contact with the rolls, the rolls are cooled to shrink. This cycle is repeated during shaping; when the wedge angle is too small, the projections (the projections 35 and 36 in the second caliber K2, and the projections 25 and 26 in the first caliber K1) have small thicknesses, and this makes heat input from the material to be rolled A easily enter from the left and right of the projections, making the rolls have higher temperatures. When the rolls have high temperatures, thermal amplitude increases to cause a heat crack, which may break the rolls. For this reason, the wedge angles θ1*a* and θ1*b* are both preferably 25° or more.

On the other hand, when the wedge angles θ1*a* and θ1*b* are large, wedge inclination angles are enlarged, which makes pressing force in the up-and-down direction due to friction force easily act on the material to be rolled A; thus, a reduction in cross-sectional area occurs at inner surface portions of flange-corresponding portions in split formation, causing a decrease in efficiency in generating flanges particularly in shaping using the second caliber K2 and subsequent calibers. Here, the relation between the wedge angle θ1*b* of the second caliber K2 and a flange width of the material to be rolled A that is finally shaped is described, and a suitable upper limit value of the wedge angle θ1*b* is described, with reference to FIG. 6.

Figure 6:
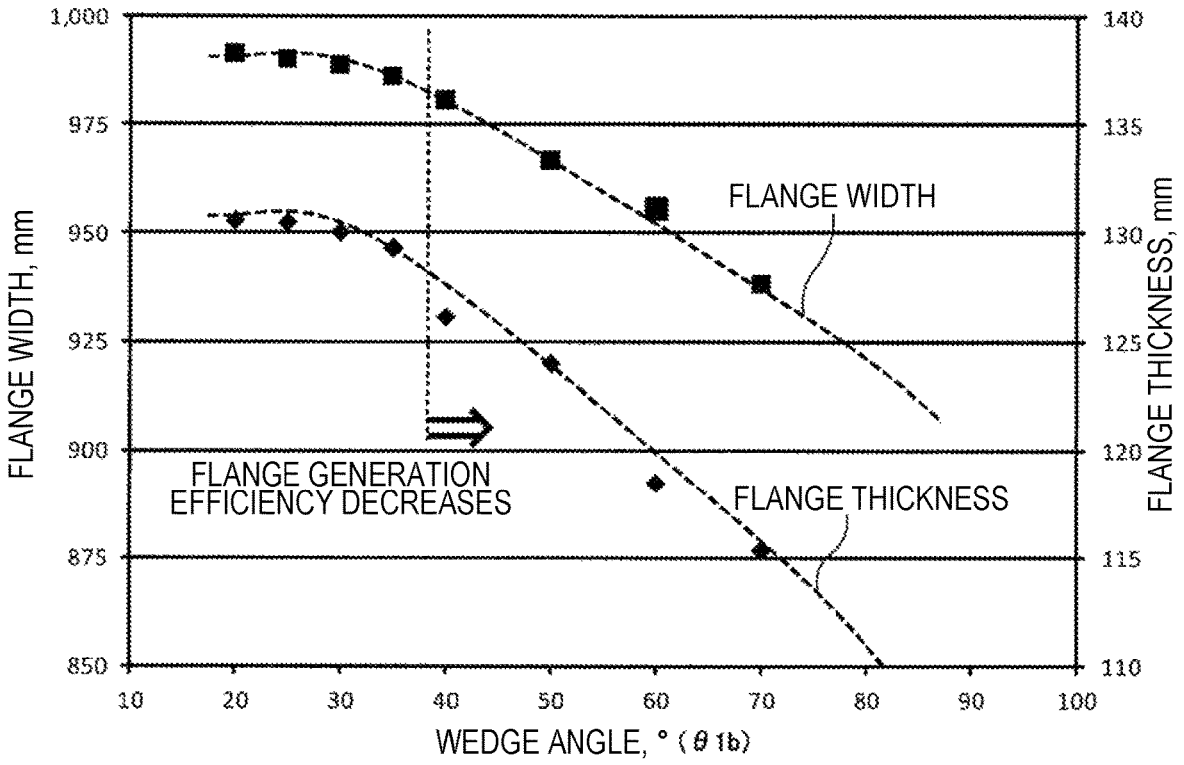
FIG. 6 is a graph showing the relation with numerical values of flange width and flange thickness when a wedge angle θ1*b* is changed.

FIG. 6 shows analysis results by a FEM, and is a graph showing the relation with numerical values of flange thickness and flange width in a subsequent step (a step using a third caliber K3 described later) when the wedge angle θ1*b* of the second caliber K2 is changed. As calculation conditions, a slab width and a slab thickness of a material are set to 2300 mm and 300 mm, respectively, and a method described in the present embodiment is used, assuming that the material to be rolled A is shaped with the wedge angle θ1*b* changed among predetermined angles, about 20° to about 70°.

As shown in FIG. 6, the graph shows that in the case where the rough rolling step is performed with the wedge angle θ1*b* set to more than 40° and an H-shaped steel product is shaped, flange width and flange thickness both decrease significantly, which indicates a decrease in efficiency in generating flanges. That is, in the case where the wedge angle θ1*b* is set to more than 40°, the graph is significantly steep, and flange width and flange thickness decrease greatly, as compared with the case where the wedge angle θ1*b* is 40° or less. As the wedge angle θ1*b* becomes more obtuse, a reduction in cross-sectional area at the flange-corresponding portions (induction of metal flow in the longitudinal direction of the material to be rolled A) increases. From this viewpoint, setting the wedge angle θ1*b* to 40° or less enables high efficiency in generating flanges to be achieved. In addition, FIG. 6 shows that it is preferable to set the wedge angle θ1*b* to 35° or less to achieve higher efficiency in generating flanges.

Moreover, for high inductivity and secured rolling stability, the wedge angle θ1*a* of the first caliber K1 is preferably the same angle as the wedge angle θ1*b* of the second caliber K2 subsequent to the first caliber K1.

Figure 7:
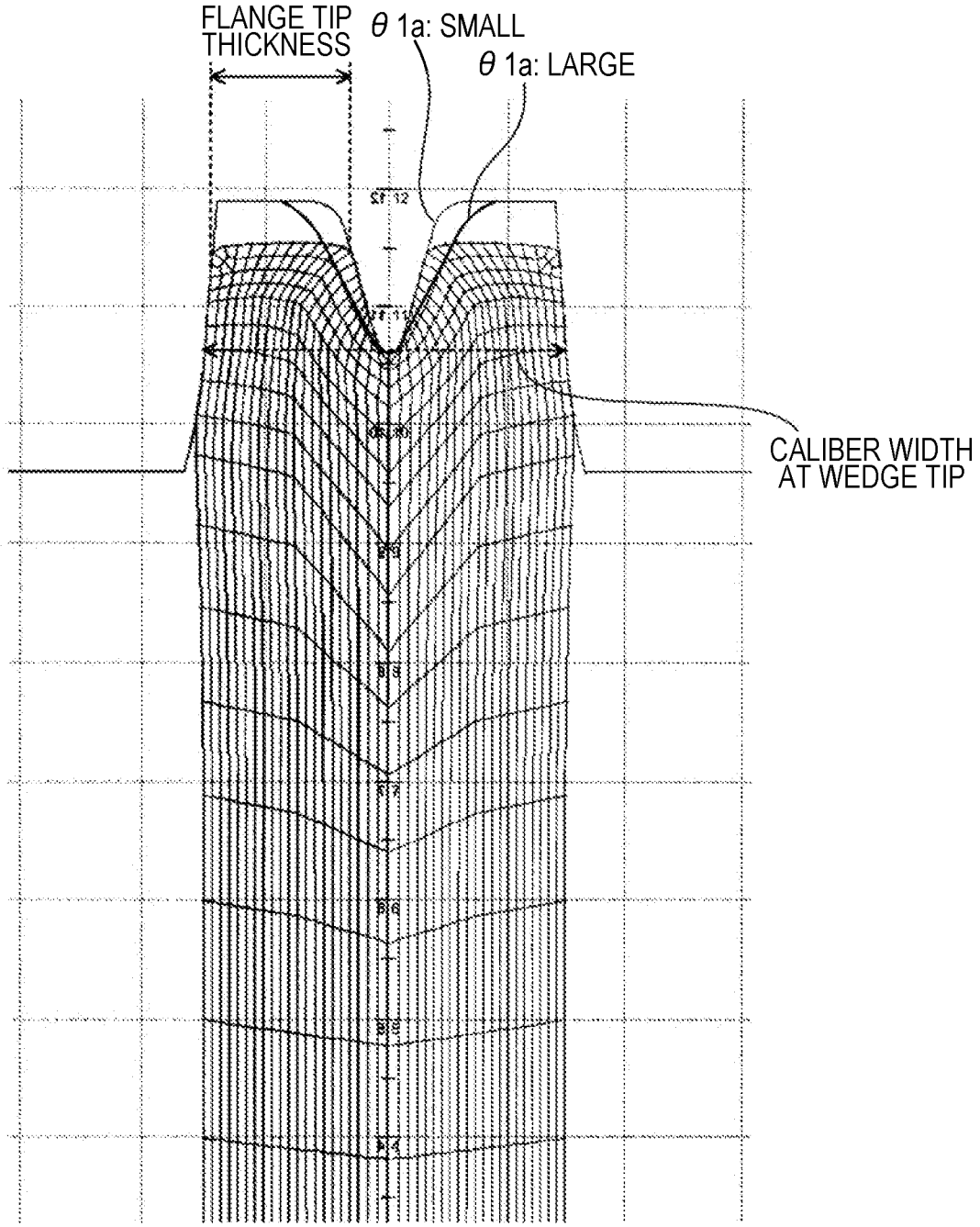
FIG. 7 is a schematic cross-sectional view of an intermediate pass of the first caliber.
Figure 8:
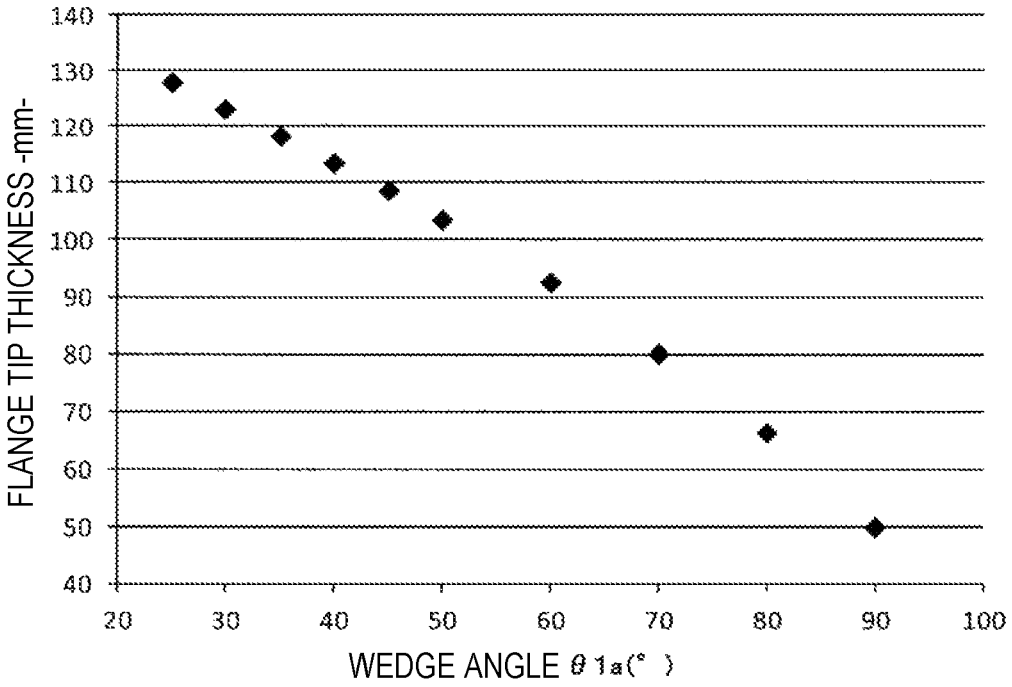
FIG. 8 is a graph showing the relation with numerical values of flange tip thickness when a wedge angle θ1*a* is changed.

In particular, the wedge angle θ1*a* of the first caliber K1 is known to greatly contribute to tip-portion thicknesses of the flange-corresponding portions (later flange portions 80); in this respect, the wedge angle θ1*a* is preferably as small as possible. FIG. 7 is a schematic cross-sectional view of an intermediate pass of the first caliber K1, and illustrates a state where the split 28 is provided on one slab end surface (the upper end portion in FIG. 2). FIG. 7 shows a difference due to the magnitude of the wedge angle θ1*a* in providing the split 28, illustrating the split shape in each case. FIG. 8 is a graph showing the relation between the wedge angle θ1*a* of the first caliber K1 and a tip thickness of a flange-corresponding portion (flange tip thickness), and shows a case where a wedge height is 100 mm and a slab thickness is 300 mm, as an example.

As shown in FIGS. 7 and 8, in a cross-section when the wedge angle θ1*a* is large, metal at slab end surfaces is lessened, which leads to a decrease in tip-portion thicknesses of the flange-corresponding portions (later flange portions 80) of the slab end surfaces, as compared with a cross-section when the wedge angle θ1*a* is small. The decrease in tip-portion thicknesses of the flange-corresponding portions (later flange portions 80) is not preferable in view of the shape of a later H-shaped steel product; hence, to ensure the tip-portion thicknesses of the flange-corresponding portions, it is necessary to determine a suitable upper limit value of the wedge angle θ1*a*.

As described above, in addition to setting the wedge angle θ1*b* of the second caliber K2 to equal to or more than 25° and equal to or less than 40°, it is preferable to set the wedge angle θ1*a* of the first caliber K1 to equal to or more than 25° and equal to or less than 40°, from the viewpoints of ensuring the tip-portion thicknesses of the flange-corresponding portions and securing inductivity and rolling stability. Furthermore, from the viewpoint of achieving high efficiency in generating flanges, it is preferable to set these wedge angles θ1*a* and θ1*b* to equal to or more than 25° and equal to or less than 35°.

A height (protrusion length) h2 of the projections 35 and 36 is configured to be larger than the height h1 of the projections 25 and 26 of the first caliber K1; h2>h1 is satisfied. Here, as described above, the tip-portion angle of the projections 35 and 36 (the wedge angle θ1*b*) is preferably the same (i.e., θ1*a*=θ1*b*) as the tip-portion angle of the projections 25 and 26 of the first caliber K1. The material to be rolled A that has passed through the first caliber K1 is further shaped in a roll gap between the upper caliber roll 30 and the lower caliber roll 31.

Here, the height h2 of the projections 35 and 36 formed in the second caliber K2 is larger than the height h1 of the projections 25 and 26 formed in the first caliber K1, and similarly, an intrusion length into the upper and lower end portions of the material to be rolled A (the slab end surfaces) is larger for the second caliber K2. An intrusion depth of the projections 35 and 36 into the material to be rolled A in the second caliber K2 is the same as the height h2 of the projections 35 and 36. That is, an intrusion depth h1' of the projections 25 and 26 into the material to be rolled A in the first caliber K1 and an intrusion depth h2 of the projections 35 and 36 into the material to be rolled A in the second caliber K2 satisfy a relation of h1'<h2.

In addition, caliber top surfaces 30*a* and 30*b* and caliber bottom surfaces 31*a* and 31*b* that face the upper and lower end portions of the material to be rolled A (the slab end surfaces) and inclined surfaces of the projections 35 and 36 form angles θf of about 90° (substantially perpendicular) at all four places illustrated in FIG. 3.

As illustrated in FIG. 3, in the second caliber K2, since the intrusion length of the projections is large when the projections are pressed against the upper and lower end portions of the material to be rolled A (the slab end surfaces), shaping is performed to make the splits 28 and 29 formed in the first caliber K1 further deeper, forming splits 38 and 39. Note that a flange half-width at the end of a flange shaping step in the rough rolling step is decided on the basis of dimensions of the splits 38 and 39 formed here.

Shaping using the second caliber K2 illustrated in FIG. 3 is performed through multiple passes, and in at least one pass of this multi-pass shaping, the upper and lower end portions of the material to be rolled A (the slab end surfaces) need to be in contact with the inside of the caliber (the top surface and the bottom surface of the second caliber K2). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the second caliber K2, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 35 and 36, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange-corresponding portions (corresponding to the flange portions 80 described later).

That is, in multi-pass shaping using the second caliber K2, it is preferable to set a pass schedule in which reduction is performed by bringing the upper and lower end portions of the material to be rolled A (the slab end surfaces) into contact with the inside of the caliber in minimum necessary passes (e.g., only the final pass), and active reduction is not performed in other passes. Also in this second caliber K2, as with the first caliber K1, an amount of reduction at the projections 35 and 36 (amount of reduction ΔT at wedge tips) is set to be sufficiently larger than an amount of reduction at the slab upper and lower end portions (amount of reduction ΔE at slab end surfaces); thus, the splits 38 and 39 are formed.

Figure 4:
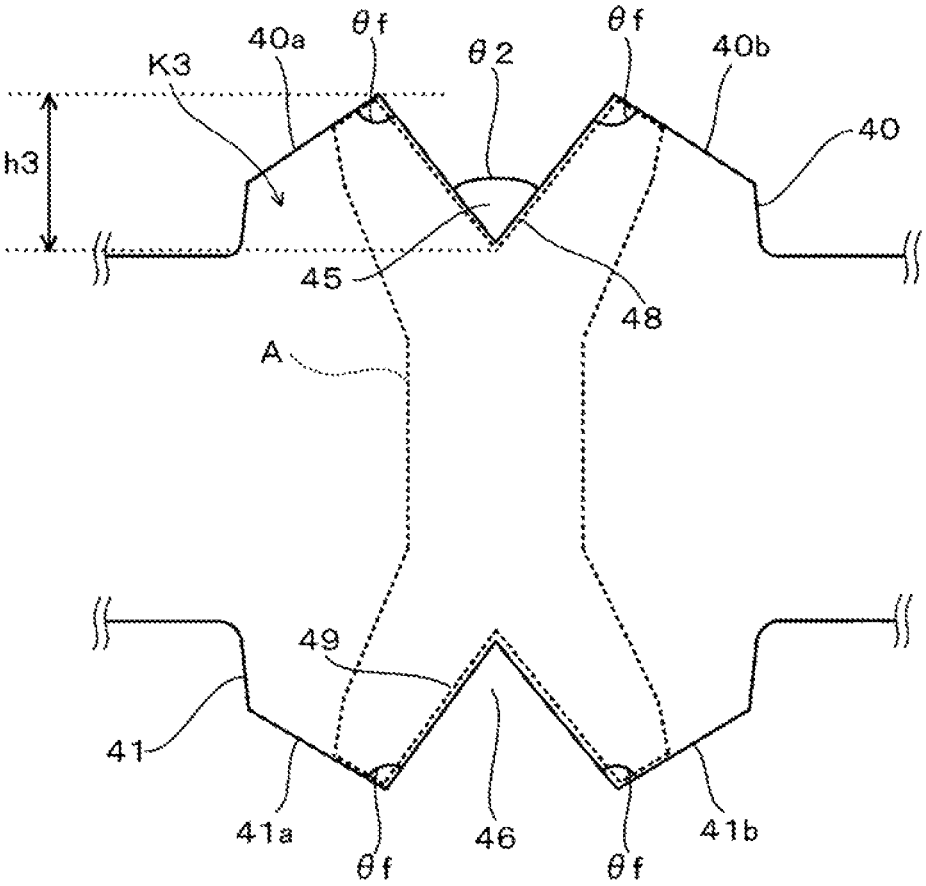
FIG. 4 is a schematic explanatory diagram of a third caliber.

FIG. 4 is a schematic explanatory diagram of a third caliber K3. The third caliber K3 is engraved on a pair of horizontal rolls, an upper caliber roll 40 and a lower caliber roll 41. On a peripheral surface of the upper caliber roll 40 (i.e., a top surface of the third caliber K3), a projection 45 protruding toward the inside of the caliber is formed. Furthermore, on a peripheral surface of the lower caliber roll 41 (i.e., a bottom surface of the third caliber K3), a projection 46 protruding toward the inside of the caliber is formed. These projections 45 and 46 have tapered shapes, and dimensions, such as protrusion length, are configured to be equal between the projections 45 and 46.

A tip-portion angle θ2 of the projections 45 and 46 is configured to be wider than the angle θ1*b*, and an intrusion depth h3 of the projections 45 and 46 into the material to be rolled A is shorter than the intrusion depth h2 of the projections 35 and 36 (i.e. h3<h2).

In addition, caliber top surfaces 40*a* and 40*b* and caliber bottom surfaces 41*a* and 41*b* that face the upper and lower end portions of the material to be rolled A (the slab end surfaces) and inclined surfaces of the projections 45 and 46 form angles θf of about 90° (substantially perpendicular) at all four places illustrated in FIG. 4.

As illustrated in FIG. 4, in the third caliber K3, the material to be rolled A that has passed through the second caliber K2 is shaped in the following manner: the projections 45 and 46 are pressed against the splits 38 and 39 formed in the second caliber K2, at the upper and lower end portions of the material to be rolled A (the slab end surfaces); thus, the splits 38 and 39 become splits 48 and 49. That is, in a final pass in shaping using the third caliber K3, a deepest-portion angle of the splits 48 and 49 (hereinafter also called a split angle) becomes θ2. In other words, shaping is performed in a manner that the divided parts (parts corresponding to the flange portions 80 described later) shaped together with the formation of the splits 38 and 39 in the second caliber K2 are bent outwardly.

Shaping using the third caliber K3 illustrated in FIG. 4 is performed through at least one pass, and in at least one pass of this shaping, the upper and lower end portions of the material to be rolled A (the slab end surfaces) need to be in contact with the inside of the caliber (the top surface and the bottom surface of the third caliber K3). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the third caliber K3, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 45 and 46, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange-corresponding portions (corresponding to the flange portions 80 described later).

In shaping in this third caliber K3, bending is performed concurrently on four parts at the upper and lower end portions of the material to be rolled A. Therefore, material-passing may become unstable depending on circumstances (e.g., when the four parts are not subjected to bending uniformly); hence, shaping in one pass is preferable. In this case, in one-pass shaping, shaping is performed in a state where the upper and lower end portions of the material to be rolled A (the slab end surfaces) are in contact with the inside of the caliber (the top surface and the bottom surface of the third caliber K3).

Figure 5:
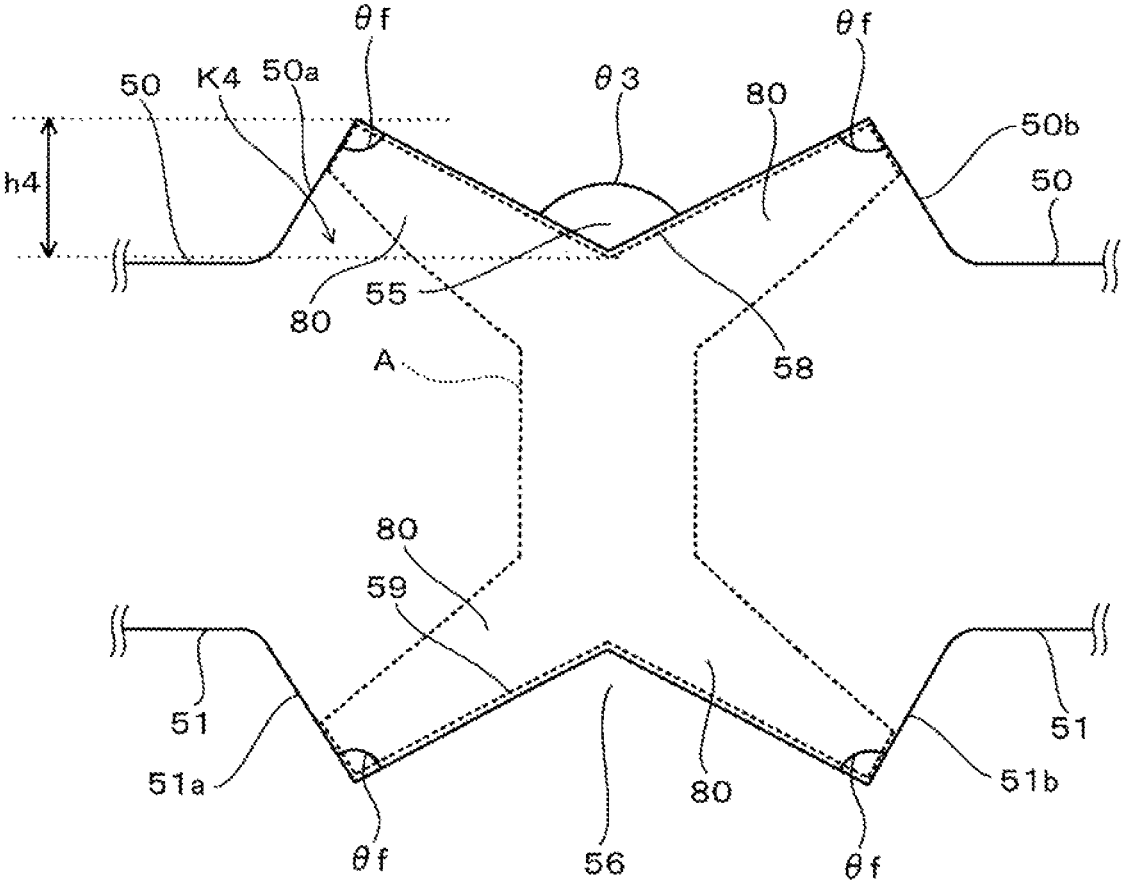
FIG. 5 is a schematic explanatory diagram of a fourth caliber.

FIG. 5 is a schematic explanatory diagram of a fourth caliber K4. The fourth caliber K4 is engraved on a pair of horizontal rolls, an upper caliber roll 50 and a lower caliber roll 51. On a peripheral surface of the upper caliber roll 50 (i.e., a top surface of the fourth caliber K4), a projection 55 protruding toward the inside of the caliber is formed. Furthermore, on a peripheral surface of the lower caliber roll 51 (i.e., a bottom surface of the fourth caliber K4), a projection 56 protruding toward the inside of the caliber is formed. These projections 55 and 56 have tapered shapes, and dimensions, such as protrusion length, are configured to be equal between the projections 55 and 56.

A tip-portion angle θ3 of the projections 55 and 56 is configured to be wider than the angle θ2, and an intrusion depth h4 of the projections 55 and 56 into the material to be rolled A is shorter than the intrusion depth h3 of the projections 45 and 46 (i.e. h4<h3).

In addition, as with the third caliber K3, caliber top surfaces 50*a* and 50*b* and caliber bottom surfaces 51*a* and 51*b* that face the upper and lower end portions of the material to be rolled A (the slab end surfaces) and inclined surfaces of the projections 55 and 56 form angles θf of about 90° (substantially perpendicular) at all four places illustrated in FIG. 5.

In the fourth caliber K4, the material to be rolled A that has passed through the third caliber K3 is shaped in the following manner: the projections 55 and 56 are pressed against the splits 48 and 49 formed in the third caliber K3, at the upper and lower end portions of the material to be rolled A (the slab end surfaces); thus, the splits 48 and 49 are expanded to become splits 58 and 59. That is, in a final pass in shaping using the fourth caliber K4, a deepest-portion angle of the splits 58 and 59 (hereinafter also called a split angle) becomes θ3. In other words, shaping is performed in a manner that the divided parts (parts corresponding to the flange portions 80 described later) shaped together with the formation of the splits 48 and 49 in the third caliber K3 are further bent outwardly. The parts at the upper and lower end portions of the material to be rolled A shaped in this manner are parts corresponding to flanges of a later H-shaped steel product, and are called flange portions 80 here. Note that the split angle θ3 of the fourth caliber K4 is preferably set to an angle somewhat smaller than 180°. This is because if the split angle θ3 is 180°, spread occurs at the outer side of the flange portions 80 when web thickness is decreased in a web thinning caliber in the next step, and overfill is likely to occur in rolling using the web thinning caliber. That is, since the amount of spread at the outer side of the flange portions 80 is decided by the shape of the web thinning caliber in the next step and an amount of reduction of the web thickness, the split angle θ3 here is preferably determined suitably with the shape of the web thinning caliber and the amount of reduction of the web thickness taken into consideration.

Shaping using the fourth caliber K4 illustrated in FIG. 5 is performed through at least one pass, and in at least one pass of this multi-pass shaping, the upper and lower end portions of the material to be rolled A (the slab end surfaces) need to be in contact with the inside of the caliber (the top surface and the bottom surface of the fourth caliber K4). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the fourth caliber K4, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 55 and 56, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange portions 80.

In shaping in this fourth caliber K4, bending is performed concurrently on four parts at the upper and lower end portions of the material to be rolled A. Therefore, material-passing may become unstable depending on circumstances (e.g., when the four parts are not subjected to bending uniformly); hence, shaping in one pass is preferable. In this case, in one-pass shaping, shaping is performed in a state where the upper and lower end portions of the material to be rolled A (the slab end surfaces) are in contact with the inside of the caliber (the top surface and the bottom surface of the fourth caliber K4).

The material to be rolled A shaped by the first to fourth calibers K1 to K4 described above is further subjected to reduction and shaping using a known caliber; thus, the H-shaped raw blank 13 with a so-called dog-bone shape is shaped. Normally, web thickness is then decreased in a web thinning caliber for thinning a portion corresponding to slab thickness. After that, reduction of normally seven to a little over ten passes is applied using a rolling mill train composed of two rolling mills of the intermediate universal rolling mill 5 and the edger rolling mill 9, which is illustrated in FIG. 1; thus, the intermediate material 14 is shaped. The intermediate material 14 is finish-rolled into a product shape in the finishing universal rolling mill 8, so that the H-shaped steel product 16 is produced.

As described above, shaping is performed in a manner that splits are created on the upper and lower end portions of the material to be rolled A (the slab end surfaces) by using the first to fourth calibers K1 to K4 according to the present embodiment, and portions divided to left and right by those splits are bent to left and right, so that the flange portions 80 are formed; thus, the H-shaped raw blank 13 can be shaped without the upper and lower end surfaces of the material to be rolled A (slab) being subjected to reduction in the up-and-down direction. That is, as compared with a conventionally performed rough rolling method in which slab end surfaces are subjected to reduction constantly, the H-shaped raw blank 13 can be shaped with a flange width widened, and consequently a final product (H-shaped steel) with a large flange width can be produced. In addition, the H-shaped raw blank 13 can be shaped without being influenced by device limits in an amount of reduction and equipment scale in the sizing mill 3 or the rough rolling mill 4; thus, a slab size of a material can be made smaller than a conventional slab size (a decrease in slab width), which enables efficient production of a final product with a large flange width.

Particularly in shaping using the second caliber K2, reduction is performed by bringing the upper and lower end portions of the material to be rolled A (the slab end surfaces) into contact with the inside of the caliber in minimum necessary passes (e.g., only the final pass), and active reduction is not performed in other passes. Thus, in forming the splits 38 and 39, shape defects caused by ununiformity in cross-sectional area between left and right flange-corresponding portions (later flange portions 80) is suppressed, which enables an efficient and stable rough rolling step.

Moreover, particularly in shaping using the third caliber K3 and the fourth caliber K4, in at least one pass of multi-pass shaping, the upper and lower end portions of the material to be rolled A (the slab end surfaces) are in contact with the inside of the caliber (the top surface and the bottom surface of the caliber). Here, contact is not necessary in all the passes; for example, the upper and lower end portions of the material to be rolled A (the slab end surfaces) are in contact with the inside of the caliber only in the final pass and the amount of reduction ΔE at slab end surfaces is a positive value (ΔE>0). Thus, in performing shaping to bend divided parts (later flange portions 80), a problem of ununiformity in cross-sectional area between the left and right divided parts, which makes material-passing unstable, can be avoided.

In addition, in each caliber (e.g., the second to fourth calibers K2 to K4), reduction is performed in minimum necessary passes and active reduction is not performed in other passes, as described above. Therefore, stretch in the longitudinal direction that accompanies reduction of the material to be rolled A is suppressed as compared with conventional stretch; thus, occurrence of a crop portion is suppressed as compared with conventional rolling for H-shaped steel, and yield is improved.

In the second to fourth calibers K2 to K4, two caliber top surfaces and two caliber bottom surfaces that face the upper and lower end portions of the material to be rolled A (the slab end surfaces) and inclined surfaces of the projections formed in the caliber form angles θf of about 90° (substantially perpendicular).

This improves material-passing property in shaping performed in the second to fourth calibers K2 to K4. In the case where the angles θf are larger than about 90°, there is a possibility that the flange-corresponding portions (later flange portions 80) are not bent along the caliber rolls. Specifically, they may be bent in angles larger than the tip-portion angles of the caliber rolls. This makes the four flange-corresponding portions ununiform in dimension and shape, which degrades material-passing property, and also leads to a decrease in product dimensions.

In addition, since tip portions of the flange-corresponding portions (later flange portions 80) are shaped to have substantially perpendicular angles at an early shaping stage, an improvement in a product shape after shaping can be expected. Particularly in the case where a large-size H-shaped steel product with wider flanges is produced, an increase in producible sizes can be expected by suitably performing shaping of flange-corresponding portions at an earlier stage.

The embodiment(s) of the present invention has/have been described above, whilst the present invention is not limited to the illustrated examples. A person skilled in the art may find various alterations and modifications within the scope of the appended claims, and it should be understood that they will naturally come under the technical scope of the present invention.

Although the above embodiment describes that the tip-portion angle θ2 of the projections 45 and 46 of the third caliber K3 is larger than θ1*b* and the tip-portion angle θ3 of the projections 55 and 56 of the fourth caliber K4 is larger than θ2, more suitable ranges can be determined in specific angles for these angles θ2 and θ3. That is, it is preferable to prescribe that the tip-portion angle θ2 of the projections 45 and 46 of the third caliber K3 is equal to or more than 70° and equal to or less than 110°, and prescribe that the tip-portion angle θ3 of the projections 55 and 56 of the fourth caliber K4 is equal to or more than 130° and equal to or less than 170°. This makes it possible to suppress occurrence of shape defects in a material to be rolled and efficiently and stably produce an H-shaped steel product with a flange width larger than a conventional flange width. Hereinafter, grounds for prescribing the suitable angle ranges of θ2 and θ3 will be described.

Figure 9:
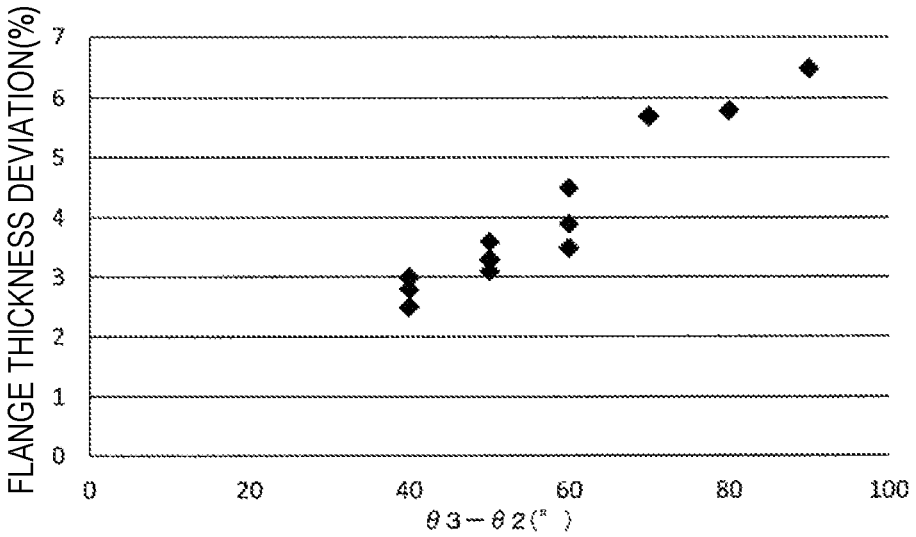
FIG. 9 is a graph showing the relation between a bending angle (θ3-θ2) in the fourth caliber and flange thickness deviation (flange thickness variations).

First, the present inventors carried out studies on a working limit (working limit angle) of bending performed in the fourth caliber K4, with respect to the material to be rolled A that has undergone shaping using the third caliber K3. FIG. 9 is a graph showing the relation between a bending angle (i.e., θ3-θ2) in the fourth caliber K4 and flange thickness deviation (flange thickness variations). Here, flange thickness deviation, the vertical axis of the graph in FIG. 9, indicates variations 3σ from the average flange thickness of four flange-corresponding portions shaped by expanding splits.

As shown in FIG. 9, when the bending angle (i.e., θ3-θ2) exceeds 60° in the fourth caliber K4, the flange thickness deviation exceeds 5%. This makes it difficult for dimensions to converge in an intermediate rolling step and a finish rolling step, which are steps subsequent to the rough rolling step; thus, shaping cannot be performed with suitable dimensional accuracy.

Thickness variations of left and right flange-corresponding portions are preferably suppressed to 5% or less for the following reason. According to JIS standard (JIS G 3192), an allowance of shape dimensions of large-size H-shaped steel is as follows: in the case where a flange thickness exceeds 40 mm, tolerance of the flange thickness is 4 mm (i.e., ±2 mm), which corresponds to 10% of a flange thickness of a product. In the case where flange dimensions of a product are out of the tolerance, correction by working is difficult, and the product is not recognized as a product with predetermined quality, which is problematic in terms of production efficiency and cost. Accordingly, it is necessary to ensure sufficient process capability in each shaping step and suppress thickness variations of left and right flange-corresponding portions in producing an H-shaped steel product. Normally, it is preferable to set tolerance of a flange thickness to 6σ to ensure sufficient process capability in each shaping step. To match 10% of a flange thickness of an H-shaped steel product with 6σ on the basis of the JIS standard, it is preferable to set the target value of thickness variations 3σ of left and right flange-corresponding portions to 5% or less.

As shown in FIG. 9, a working angle in the fourth caliber K4 needs to be 60° or less. That is, a difference between the tip-portion angle θ2 of the projections 45 and 46 of the third caliber K3 and the tip-portion angle θ3 of the projections 55 and 56 of the fourth caliber K4 needs to be 60° or less, and needs to be designed to satisfy an expression (1) below.

$$\theta 3-\theta 2 \leq 60^\circ \quad (1)$$

Figure 10:
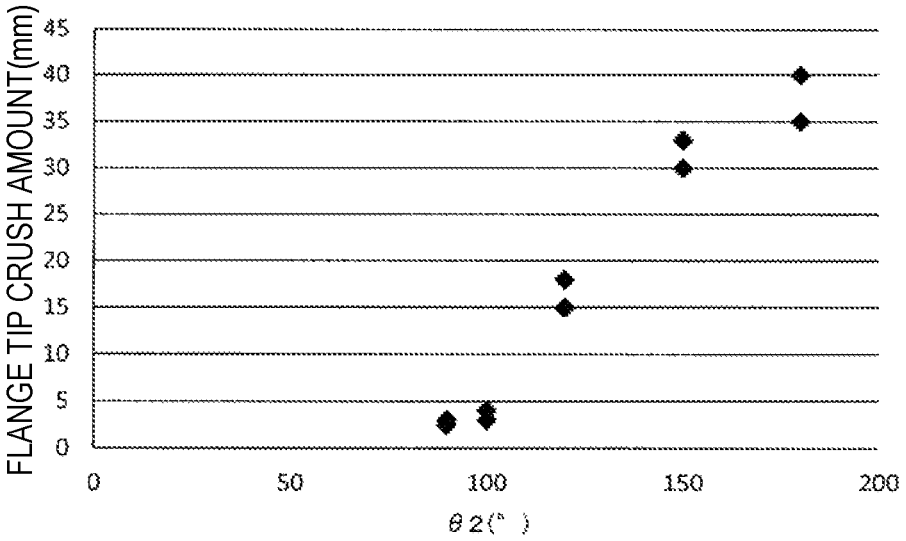
FIG. 10 is a graph showing an amount of change in thickness at tips of flange-corresponding portions (flange tip crush amount) when the tip-portion angle θ2 in the third caliber is changed.

Next, the present inventors carried out studies on an upper limit value of the tip-portion angle θ2 of the projections 45 and 46 of the third caliber K3. FIG. 10 is a graph showing an amount of change in width at tips of flange-corresponding portions (flange tip crush amount) when the tip-portion angle θ2 in the third caliber K3 is changed.

Figure 11:
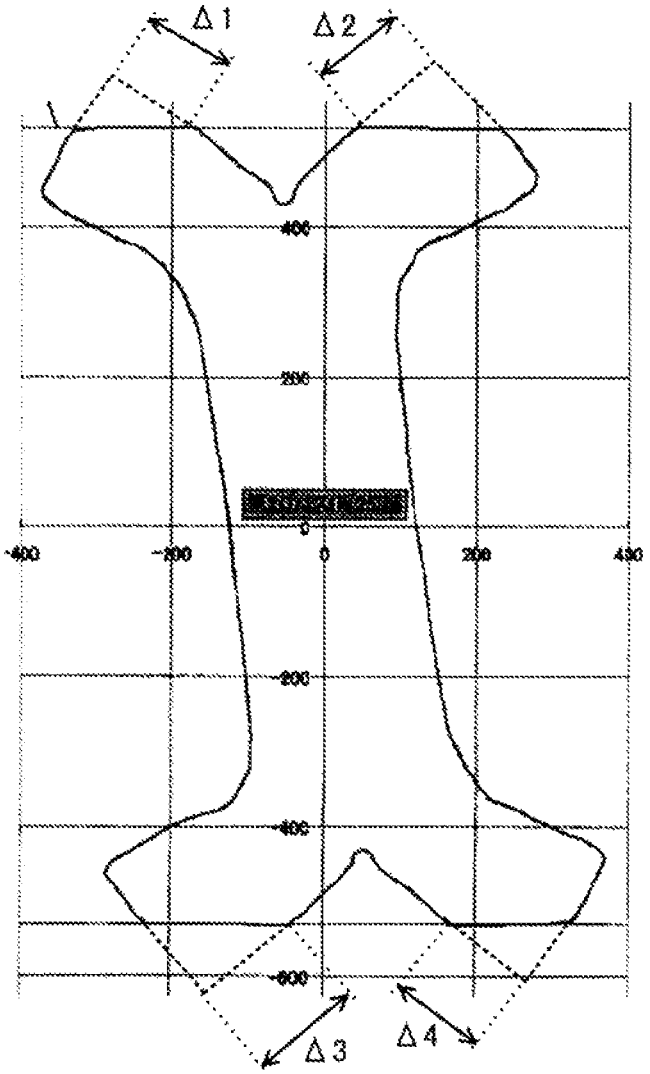
FIG. 11 is a schematic diagram illustrating the shape of a material to be rolled after shaping when a method according to the present embodiment is used and the tip-portion angle θ2 of the projections of the third caliber is set to more than 110°.

The flange tip crush amount is defined by the average value of crushed distances Δi (i=1 to 4: corresponding to four tips) with respect to the tip width direction of the flange-corresponding portions bent in the third caliber K3. FIG. 11 described later illustrates these flange tip crush amounts Δ1 to Δ4.

As shown in FIG. 10, when the angle θ2 is 100° or less, the amount of change in tip width of the flange-corresponding portions stays at a low level of 5 mm or less. However, when the angle θ2 is 110° or more, the amount of change in tip width of the flange-corresponding portions is also large, and cross-sectional area imbalance occurs between the four flange-corresponding portions (see FIG. 11 described later).

FIG. 11 is a schematic diagram illustrating the shape of a material to be rolled after shaping when a method according to the present embodiment is used and the tip-portion angle θ2 of the projections 45 and 46 of the third caliber K3 is set to more than 110°. As illustrated in FIG. 11, when shaping using the third caliber K3 is performed with the angle θ2 set to more than 110°, deformation in which outer side surfaces of the flange-corresponding portions are crushed is easier than deformation due to bending, and this leads to a deformation mode in which metal at the outer side of the flange-corresponding portions is lessened.

According to the above description referring to FIGS. 10 and 11, the tip-portion angle θ2 of the projections 45 and 46 of the third caliber K3 needs to be designed to satisfy an expression (2) below.

$$\theta 2 \leq 110^\circ \tag{2}$$

Figure 12:
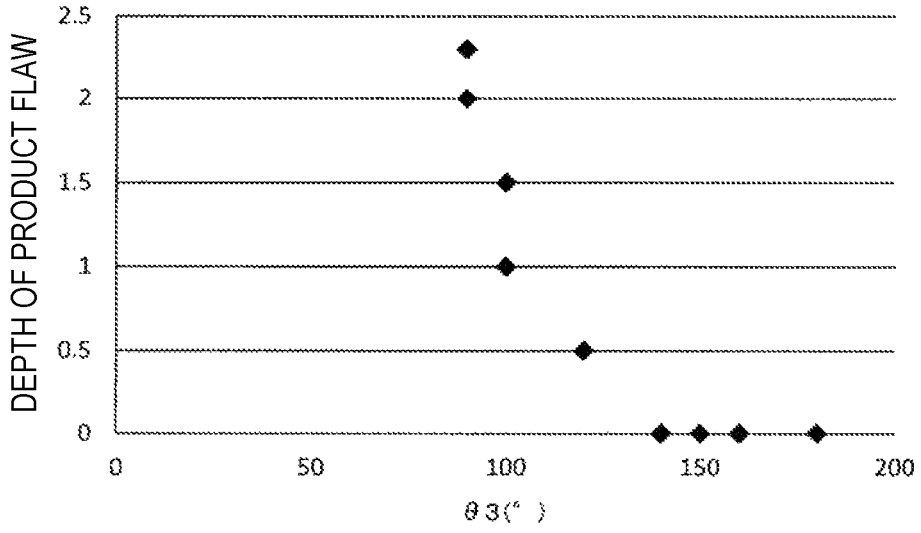
FIG. 12 is a graph showing a change in the depth of a product flaw when the tip-portion angle θ3 of the fourth caliber is changed.

Then, the present inventors carried out studies on an upper limit value and a lower limit value of the tip-portion angle θ3 of the projections 55 and 56 of the fourth caliber K4, on the basis of shaping using a web thinning caliber. FIG. 12 is a graph showing the depth of a product flaw that occurs with occurrence of material accumulation in a subsequent step performed in the web thinning caliber when the tip-portion angle θ3 of the projections 55 and 56 of the fourth caliber K4 is changed. Material accumulation that occurs in the web thinning caliber refers to a projection-like shape defect that occurs at an outer surface of a flange-corresponding portion; details thereof will be described later with reference to FIG. 13.

As shown in FIG. 12, in the case where the angle θ3 is less than 130°, a product flaw occurs, and the product flaw increases in depth as the angle θ3 becomes smaller. Then, this product flaw remains on a flange outer surface of a final product.

Figure 13:
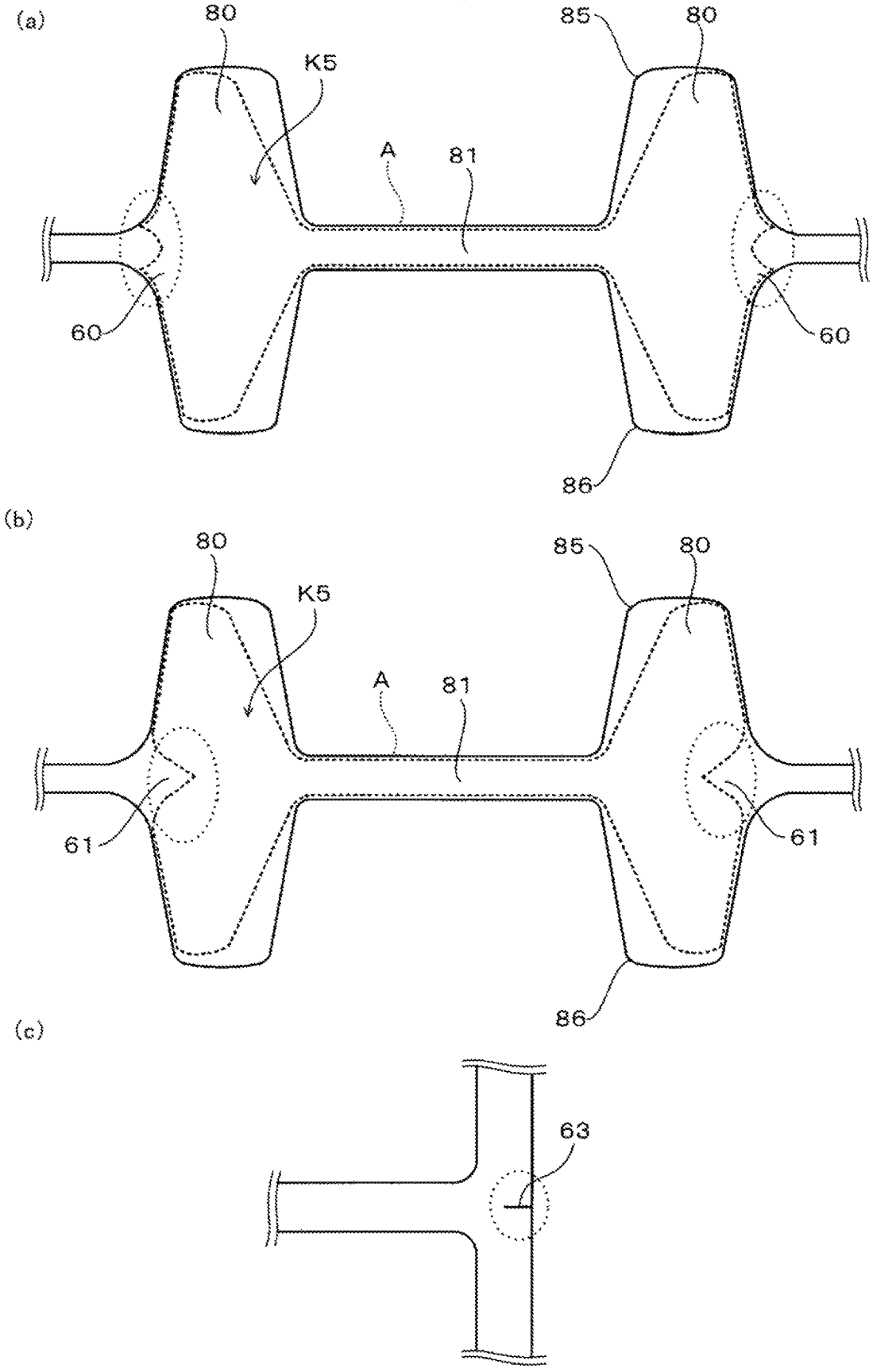
FIG. 13 is a schematic explanatory diagram related to web thinning in a web thinning caliber.

FIG. 13 is a schematic explanatory diagram related to web thinning in a web thinning caliber; (a) illustrates a case where shape defects occur at outer surfaces of flange portions when the angle θ3 is more than 170°, (b) illustrates a case where shape defects occur at outer surfaces of flange portions when the angle θ3 is less than 130°, and (c) illustrates a product flaw.

As illustrated in FIG. 13(*a*), in the case where web thinning is performed in the web thinning caliber, thinning of a web portion 81 is accompanied by an increase in the amount of spread of metal to the outer side of the flange portions 80 (the left-right direction in the drawing). The amount of spread increases as the proportion of a cross-section of the web portion 81 in the whole cross-section becomes larger. Thus, swelled portions 60 like projections indicated by the broken-line portions in the drawing are formed. These swelled portions 60 cause shape defects; hence, a possible countermeasure is to provide a concavity to allow for spread at outer surfaces of the flange portions 80. To adjust the amount of concavity, it is effective to suitably determine the tip-portion angle θ3 of the projections 55 and 56 of the fourth caliber K4. It has been found by experiment that shape defects as illustrated in FIG. 13(*a*) occur when the angle θ3 is set to more than 170'; thus, the upper limit value of the angle θ3 is 170°.

The upper limit value of the angle θ3 is determined as 170° also from the facts that the upper limit value of the angle θ2 is 110° and the difference between the angle θ3 and the angle θ2 is 60° at maximum, according to the expression (1) and the expression (2).

As illustrated in FIG. 13(*b*), in the web thinning caliber, width reduction is performed on the flange portions 80 concurrently with thinning of the web portion 81. Width reduction performed on the flange portions 80 applies reduction strain to center portions of the flange portions 80 from above and below; when the angle θ3 is less than 130°, grooves 61 formed in center portions of outer side surfaces of the flange portions 80 (the portions surrounded by broken lines in the drawing) remain as flaws without being erased, and accordingly product flaws occur, the product flaws remaining in H-shaped steel, which is a final product. It has been found by experiment that when the angle θ3 is set to less than 130°, the grooves 61 illustrated in FIG. 13(*b*) remain as starting points of flaws, causing a product flaw 63 as illustrated in FIG. 13(*c*).

According to the above description referring to FIGS. 12 and 13, the tip-portion angle θ3 of the projections 55 and 56 of the fourth caliber K4 preferably has an upper limit value of 170°, and preferably has a lower limit value of 130°.

Particularly on the basis of FIG. 12, the angle θ3 needs to be designed to satisfy an expression (3) below.

$$\theta 3 \geq 130^\circ \tag{3}$$

Figure 14:
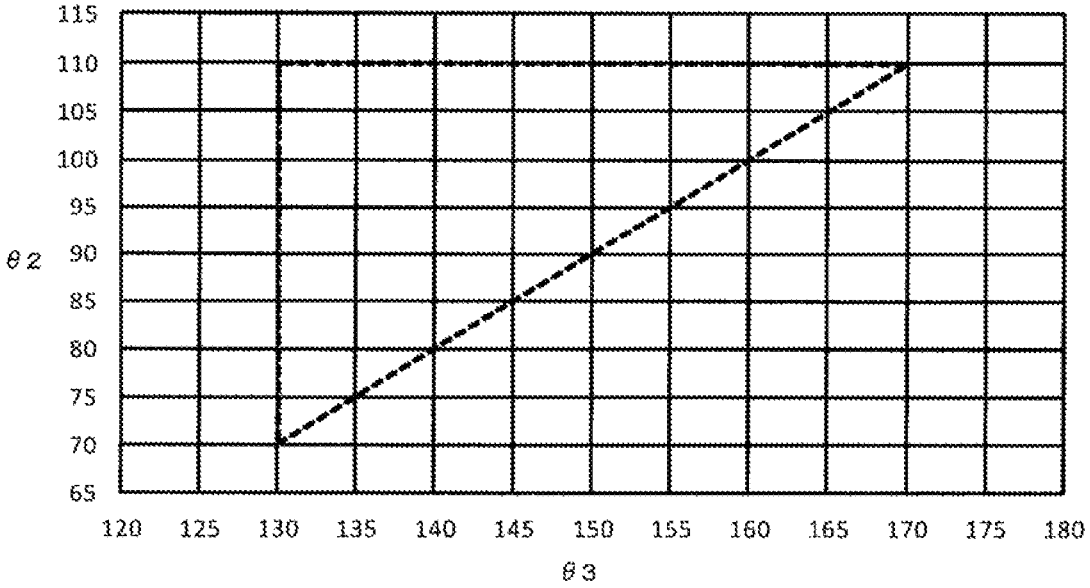
FIG. 14 is a graph showing a suitable design range of θ2 and θ3.

In the case where design conditions are configured to satisfy all the expressions (1) to (3) described above, the lower limit value of θ2 is 70° (=130°−) 60°, and the upper limit value of θ3 is 170° (=110°+60°). FIG. 14 is a graph collectively showing the design conditions expressed in the expressions (1) to (3), and shows a suitable design range of θ2 and θ3. The range surrounded by lines indicating the conditions (the broken lines in the drawing) in FIG. 14 is the suitable design range. That is, the angle θ2 needs to be designed to satisfy an expression (4) below, and the angle θ3 needs to be designed to satisfy an expression (5) below, and also the expression (1) needs to be satisfied.

$$70^\circ \leq \theta 2 \leq 110^\circ \tag{4}$$

$$130^\circ \leq \theta 3 \leq 170^\circ \tag{5}$$

The tip-portion angle θ2 of the projections 45 and 46 of the third caliber K3 and the tip-portion angle θ3 of the projections 55 and 56 of the fourth caliber K4 are determined by design conditions that satisfy the expressions (1), (4), and (5). Thus, shaping is performed without causing deformation imbalance between the left and right flange portions 80, and furthermore, each shaping step can be performed without causing shape defects such as deformation in which the outer side surfaces of the flange-corresponding portions are crushed (see FIG. 11), or shape defects such as creation of a material accumulation shape in the center portions of the outer side surfaces of the flange portions 80 in the web thinning caliber, which causes product flaws (see FIG. 13).

For example, in the above embodiment, description is given assuming that the four calibers of the first to fourth calibers K1 to K4 are engraved to perform shaping of the material to be rolled A, but the number of calibers for performing the rough rolling step is not limited to this. That is, the number of calibers engraved in the sizing mill 3 and the rough rolling mill 4 can be changed arbitrarily, and is changed as appropriate to the extent that the rough rolling step can be performed suitably.

The above embodiment describes that shaping of bending the flange-corresponding portions (later flange portions 80) is performed by using the third caliber K3 and the fourth caliber K4. This is because it is preferable to assign a plurality of calibers (the third caliber K3 and the fourth caliber K4 in the above embodiment) to bending shaping, because if bending shaping is performed with the bending angle (i.e., the wedge angle in each caliber) rapidly increased, friction force between the projections and the material to be rolled A is likely to cause a reduction in cross-sectional area, and bending power increases, which may impair uniformity in cross-sectional area between the four flange-corresponding portions (later flange portions 80). According to experimental results by the present inventors, it is preferable to perform bending shaping in two calibers of the third caliber K3 and the fourth caliber K4 described in the above embodiment.

The material (material to be rolled A) in producing the H-shaped steel is described to be a slab, but the present invention is also applicable to other materials with similar shapes, as a matter of course. That is, the present invention can also be applied to a case where, for example, a beam blank material is shaped to produce H-shaped steel.

INDUSTRIAL APPLICABILITY

The present invention can be applied to a method for producing H-shaped steel using a slab or the like having a rectangular cross-section as a material, for example.

The invention claimed is:

1. A method for producing H-shaped steel, the method comprising:

a rough rolling step;

an intermediate rolling step; and a finish rolling step, wherein in a rolling mill that performs the rough rolling step, a plurality of calibers to shape a material to be rolled are engraved, the number of the plurality of calibers being four or more, shaping of one or a plurality of passes is performed on the material to be rolled in the plurality of calibers, in a first caliber and a second caliber among the plurality of calibers, projections to create splits vertically with respect to a width direction of the material to be rolled are formed, in a second caliber and subsequent calibers among the plurality of calibers, reduction is performed in a state where end surfaces of the material to be rolled are in contact with caliber peripheral surfaces in shaping of at least one pass, in two or more of a third caliber and subsequent calibers among the plurality of calibers, a step of sequentially bending divided parts formed by the splits is performed, and the projections formed in the first caliber and the second caliber have a tip angle of 40° or less.

2. The method for producing H-shaped steel according to claim 1, wherein the pass in which reduction is performed in a state where the end surfaces of the material to be rolled are in contact with the caliber peripheral surfaces is a final pass in shaping of a plurality of passes using each of the second caliber and subsequent calibers among the plurality of calibers.

3. The method for producing H-shaped steel according to claim 1, wherein in the second caliber, inclined surfaces of the projections and caliber peripheral surfaces that are adjacent to the inclined surfaces and face the end surfaces of the material to be rolled form substantially perpendicular angles.

4. The method for producing H-shaped steel according to claim 1, wherein the projections formed in the first caliber and the second caliber have a tip angle of equal to or more than 25° and equal to or less than 35°.

5. The method for producing H-shaped steel according to claim 1, wherein projections that are pressed against the divided parts to bend the divided parts are formed in the third caliber and subsequent calibers among the plurality of calibers, and inclined surfaces of the projections and caliber peripheral surfaces that are adjacent to the inclined surfaces and face the end surfaces of the material to be rolled form substantially perpendicular angles.

6. The method for producing H-shaped steel according to claim 5, wherein the projections formed in the second caliber and subsequent calibers among the plurality of calibers have tip angles sequentially increasing toward subsequent calibers.

7. The method for producing H-shaped steel according to claim 1, wherein the plurality of calibers are four calibers of first to fourth calibers to shape the material to be rolled, in the third caliber and the fourth caliber among the plurality of calibers, a step of sequentially bending divided parts formed by the splits is performed, projections formed in the third caliber have a tip angle of equal to or more than 70° and equal to or less than 110°, and projections formed in the fourth caliber have a tip angle of equal to or more than 130° and equal to or less than 170°.

8. The method for producing H-shaped steel according to claim 1, wherein the projections formed in the first caliber and the second caliber have a tip angle of equal to or more than 25° and equal to or less than 35°, projections that are pressed against the divided parts to bend the divided parts are formed in the third caliber and subsequent calibers among the plurality of calibers, and inclined surfaces of the projections and caliber peripheral surfaces that are adjacent to the inclined surfaces and face the end surfaces of the material to be rolled form substantially perpendicular angles.

9. The method for producing H-shaped steel according to claim 1, wherein the projections formed in the first caliber and the second caliber have a tip angle of equal to or more than 25° and equal to or less than 35°, projections that are pressed against the divided parts to bend the divided parts are formed in the third caliber and subsequent calibers among the plurality of calibers, and inclined surfaces of the projections and caliber peripheral surfaces that are adjacent to the inclined surfaces and face the end surfaces of the material to be rolled form substantially perpendicular angles, and the projections formed in the second caliber and subsequent calibers among the plurality of calibers have tip angles sequentially increasing toward subsequent calibers.

10. The method for producing H-shaped steel according to claim 1, wherein the projections formed in the first caliber and the second caliber have a tip angle of equal to or more than 25° and equal to or less than 35°, the plurality of calibers are four calibers of first to fourth calibers to shape the material to be rolled, in the third caliber and the fourth caliber among the plurality of calibers, a step of sequentially bending divided parts formed by the splits is performed, projections formed in the third caliber have a tip angle of equal to or more than 70° and equal to or less than 110°, and projections formed in the fourth caliber have a tip angle of equal to or more than 130° and equal to or less than 170°.

* * * * *